US005364228A

United States Patent [19]

Henning et al.

[11] Patent Number: 5,364,228

[45] Date of Patent: Nov. 15, 1994

[54] TURBINE FOR GAS COMPRESSION

[75] Inventors: Hans-Heinrich Henning, Ennepetal; Dieter Frohn, Wuppertal; Carldieter Hollmann, Witten; Walter Winkelströter; Frank Diedrichsen, both of Wuppertal, all of Germany

[73] Assignee: Gebr, Becker GmbH & Co., Wuppertal, Germany

[21] Appl. No.: 52,687

[22] Filed: Apr. 27, 1993

[30] Foreign Application Priority Data

Apr. 27, 1992 [DE] Germany ..... 4213765
Sep. 15, 1992 [DE] Germany ..... 4230770

[51] Int. Cl.[5] ..... F04D 5/00

[52] U.S. Cl. ..... 415/55.1; 415/55.6; 415/143

[58] Field of Search ..... 415/55.1, 55.2, 55.5, 415/55.6, 55.7, 143; 416/183, 184, 185, 188

[56] References Cited

U.S. PATENT DOCUMENTS

| | | | |
|---|---|---|---|
| 2,469,125 | 5/1949 | Meisser | 415/143 |
| 2,484,554 | 10/1949 | Concordia et al. | 416/188 |
| 3,904,308 | 9/1975 | Ribaud | 415/143 |
| 3,936,240 | 2/1976 | Dochtermann . | |
| 3,936,243 | 2/1976 | Gakenholz | 415/55.1 |
| 4,093,401 | 6/1978 | Gravelle | 415/143 |
| 4,530,639 | 7/1985 | Mowill | 416/184 |
| 4,973,220 | 11/1990 | Soar et al. | 415/55.1 |

FOREIGN PATENT DOCUMENTS

| | | |
|---|---|---|
| 474906 | 4/1929 | Austria . |
| 4862 | 7/1953 | German Dem. Rep. . |
| 41513 | 9/1965 | German Dem. Rep. . |
| 35450 | 11/1965 | German Dem. Rep. . |
| 1403579 | 4/1961 | Germany . |
| 2112980 | 3/1971 | Germany . |
| 3128374 | 7/1981 | Germany . |
| 68264 | 7/1951 | Netherlands . |

*Primary Examiner*—John T. Kwon
*Attorney, Agent, or Firm*—Antonelli, Terry, Stout & Kraus

[57] ABSTRACT

A turbine including a radial compressor having radial blades, with the compressor supplying side channel compressors arranged at its circumference and having chamber blades. To increase the efficiency, the chamber blades and the radial blades are curved in opposite directions, with the chamber blades and radial blades having a curvature transition point at their transition area, and the blades, in the transition area, are inclined by an identical angle of less than 30° and, for example, 15° relative to a circumferential tangent in the transition area.

20 Claims, 7 Drawing Sheets

TURBINE FOR GAS COMPRESSION

FIELD OF THE INVENTION

The invention relates to a turbine with a radial compressor rotor having radial blades, said rotor feeding a side channel compressor, said compressor comprising a ring of chambers separated by chamber blades mounted on the rotor, with the annular diameter of the side channel of the side channel compressor being the same size as or larger than the diameter of the part of the rotor bearing the radial blades, said chambers also having openings on the side abutting the outer ends of the radial blades, and with the radial blades gradually merging with the chamber blades in the flow direction.

BACKGROUND OF THE INVENTION

Turbines are generally designed as radial compressors or as side channel compressors. Radial compressors are used primarily for generating high-volume flows, and side channel compressors for generating high pressure differentials.

DE 31 28 374 A1, teaches a side channel pump supported by radial blades and usable for gaseous media, with the rotor having radial blades bent convex at one end, said blades urging the medium being transported into a circumferential channel that expands helically, from which the transported medium is conducted into a side channel pump whose radially directed chamber blades are mounted either on the side of the rotor opposite the radial blades or, on the outer circumference of the rotor. The medium, transported outward therein by the radial blades, is conducted over a relatively long distance with multiple deflections to the side channel, considerably reducing its efficiency.

DD-PS 4862 teaches a multistage turbine according to the species, but designed for liquid media in that publication, with the first stage designed as a radial compressor whose radial blades gradually merge with the chamber blades of the second stage, designed as a side channel compressor. The chambers of the side channel compressor surrounding the radial blades are open on the side facing the radial blades, so that the medium being transported enters the chambers of the side channel compressor directly from the flow channels of the radial compressor. However, the chamber blades are aligned radially, and the radial blades, curved only slightly concavely, make a direct transition to the chamber blades. Consequently, a pressure that develops in the side channel chambers results in backpressure that is unimpeded and directed radially inward into the flow channels of the radial compressor, limiting the efficiency that can be attained.

In addition, DD-PS 35 450 teaches a self-priming liquid centrifugal pump, whose rotor is provided in its central area with convexly curved radial blades and in its circumferential area with convexly bent chamber blades. The radial blades run inside a cylindrical housing intermediate jacket, interrupted at only one point over an arc of about 60°, so that the liquid flow can make the transmission from the radial pump to the circumferential channel which has chamber blades only at this interruption. Since the spacing of the radial blades and chamber blades is equal to at least the thickness of the housing intermediate jacket, considerable turbulence occurs at the transition, considerably limiting the efficiency that can be attained.

DD-PS 41 513 teaches a combined rotor for pumps, compressors, or the like with curved radial blades that convey the medium centrally into a circumferential channel fitted on two opposite sides with straight chamber blades directed radially. The medium flow generated by the radial blades is broken up at the outer circumferential wall of the circumferential channel and deflected toward the chamber blades, so that two circular flows directed in opposite directions develop in the circumferential channel and impact the medium flow generated by the radial blades. Since this medium flow abruptly loses the guidance provided by the radial blades upon entering the circumferential channel, considerable turbulence and rapid backpressure develop, so that only very limited efficiency can be attained with this known device.

SUMMARY OF THE INVENTION

The goal of the invention is to provide a high-efficiency turbine that is also suitable for circulating a laser gas.

Taking its departure from a turbine of the type described at the outset, the goal is achieved according to the invention by virtue of the fact that the turbine is designed as a gas compressor, by the fact that in an end view the chamber blades and the radial blades each have opposite curvatures, the fact that the chamber blades and the radial blades undergo a change in curvature at their transition points, and the fact that the blades are inclined at a similar angle of less than 30°, for example 15°, to the circumferential tangent at the transition point. The smaller this angle is, the greater the pressure build up in the radial compressor with decreasing volume flows, and the sharper the angle at which the chamber blades can be set relative to the incoming gas flow, producing a circulatory flow with a limited helical pitch height, so that the gas flow in the side channel compressor undergoes an especially pronounced increase in pressure through an exchange of momentum.

The efficiency of the turbine can also be increased even further by tilting the radial blades, which essentially project at right angles from the rotor at their radial inner ends, and by tilting the following chamber blades, to a degree that increases with their length, forward relative to the plane of the rotor, i.e. in the direction of rotation of the rotor.

The large annular diameter of the toroidal side channel means that the chamber blades of the side channel compressor achieve a higher circumferential velocity than do the radial blades. Because of its greater circumferential velocity, the side channel compressor can absorb the volume of gas supplied by a radial compressor with a high absorption volume, said gas volume then being compressed to a high pressure in the side channel compressor as the next working stage. Since the volume of gas supplied by the radial compressor enters the chambers of the side channel compressor at high velocity in any case, a circulatory motion immediately develops in the side channel, so that the side channel compressor is utilized especially effectively over its circumference. The chambers of the side channel compressor initially receive the maximum volume flows from the radial compressor downstream from the interrupter; the incoming volume flows are reduced, corresponding to the pressure buildup in the side channel, at the front of the interrupter. The entrainment losses which also unavoidable occur here in the side channel compressor in the vicinity of the interrupter are low in the turbine according to the invention, since the highly compressed gas volumes entrained by the chambers in the vicinity of the interrupter do not then expand against the intake pressure as in an ordinary single-stage side channel compressor but only against the increased intermediate pressure already generated by the radial compressor. In addition, the gas flow undergoes only comparatively minor deflection at the transition from the radial compressor to the side channel compressor, since the flow direction at this transition point remains directed radially outward, and impact and separation losses are avoided by the continuous transition, extending nearly in the circumferential direction, between the radial blades and the chamber blades. The turbine operates with a continuous intake pressure and expels with minor pulsations, and is thereby relatively quiet. All in all, the invention produces a low-noise, high-efficiency turbine.

In accordance with the invention, the chamber blades can have a widening directed toward the side channel of the side channel compressor, with the chambers in the vicinity of these widenings being closed at the radially inward end by a sealing wall. These measures can provide a large chamber volume for side channel compressors, and the radial dimensions of the turbine can be kept relatively small.

According to the invention, provision can also be made for decreasing the height of the radial blades radially outward, and for the radial blades being provided on their sides opposite the rotor with a covering wall on the housing side or a covering disk molded on the rotor, and by the covering wall or covering disk simultaneously forming the sealing wall of the chambers in the vicinity of the widenings. As a consequence of these measures, the flow channels located between two adjacent radial blades are shaped outward in such a way that the radial compressor feeds the chambers of the side channel compressor at high pressure, with the gas supplied immediately being given the typical circulatory motion of a side channel compressor.

The height of the radial blades and the cross section of the flow channels delimited by them are designed in accordance with the optimum flow volume of the side channel compressor.

The end of the rotor that bears the radial blades is advantageously conical and the radial blades are inclined at an angle in their lengthwise dimension relative to the rotor axis, so that the gas drawn in axially is deflected only gradually in the radial direction.

The turbine according to the invention can be equipped with only one interrupter, which is recommended for a consumer who wishes to operate at a high pressure, e.g. the maximum pressure that can be produced with the turbine according to the invention. Alternatively, the invention can also have associated with it a plurality of interrupters on the side channel compressor which terminate in a common annular collecting chamber in order to supply a consumer with a high volume requirement.

According to another alternative, however, provision can be made such that in the event of a plurality of interrupters, each interrupter has associated with it a collecting chamber of its own with an outlet, so that a plurality of consumers can be supplied simultaneously by the turbine. In this way it is possible to make the divisions of the side channel, i.e. the angular spaces between the interrupters, unequal, so that different pressure/volume flows develop and so that a plurality of consumers with different pressure/volume requirements can be supplied.

Additional features of the invention are listed in the subclaims and described in greater detail below with reference to the description of the figures.

BRIEF DESCRIPTION OF THE DRAWINGS

The invention will now be described with reference to several embodiments shown in the drawing in greater detail.

DETAILED DESCRIPTION

Figure 1:
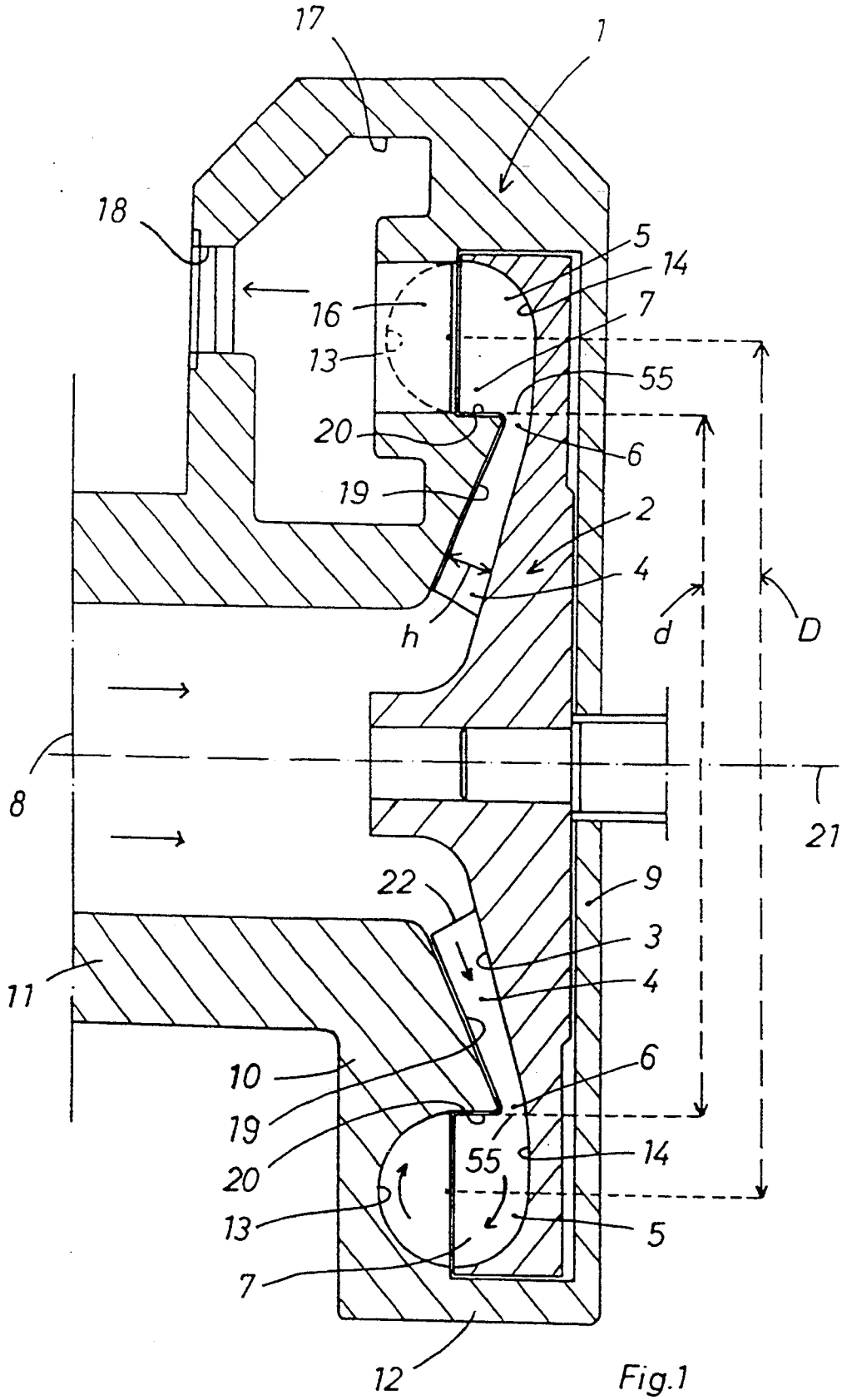
FIG. 1 is a turbine according to the invention, in an axial section.
Figure 2:
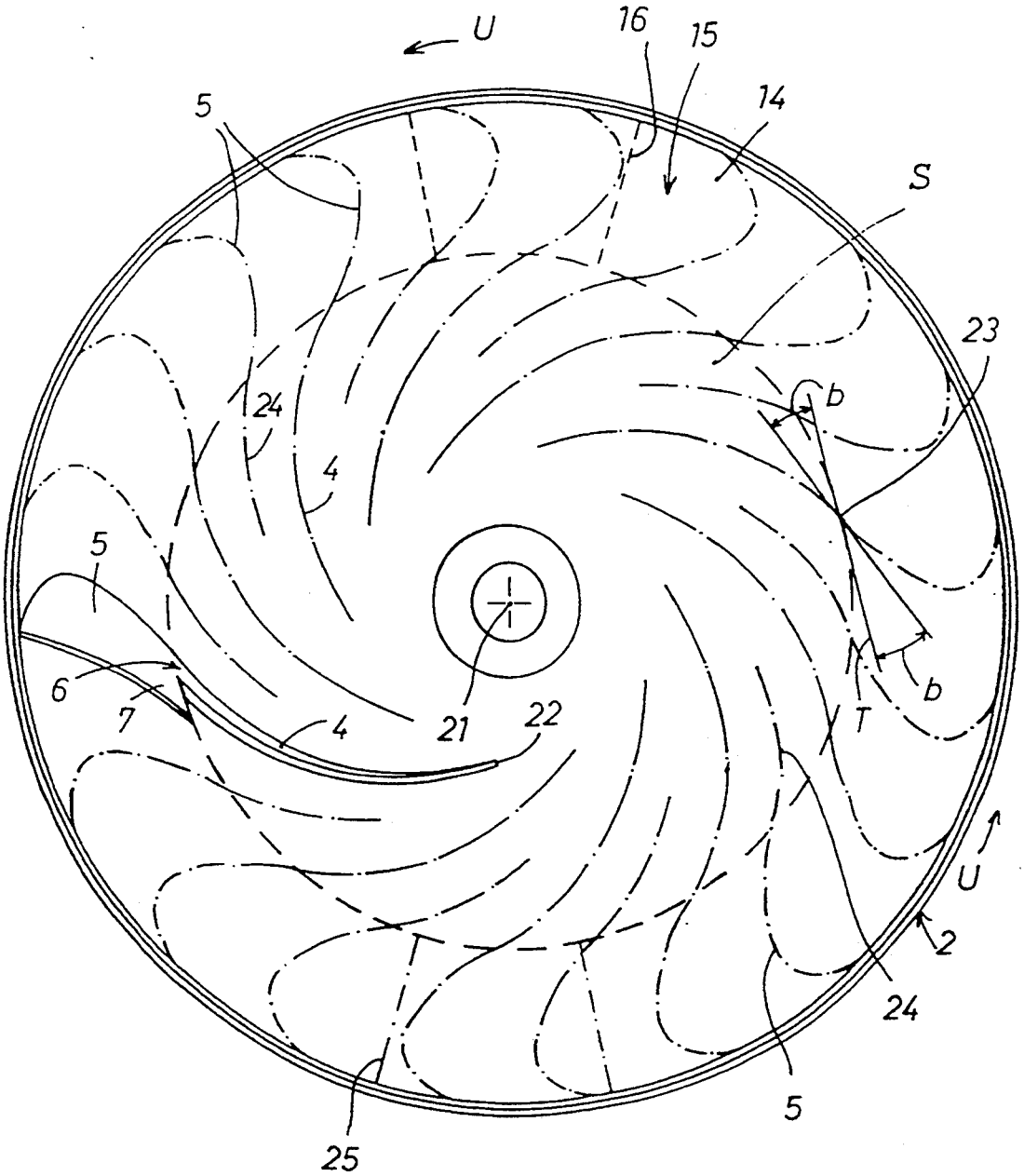
FIG. 2 is an end view of the rotor of the turbine according to FIG. 1.

The turbine shown in FIGS. 1 and 2 for gas compression is provided with a rotor 2 surrounded by a housing 1, said rotor having on one end 3 convexly curved radial blades 4 that merge uniformly radially outward with concave chamber blades 5. Chamber blades 5 have an axially directed widening 7 directed opposite the dimension of the outer ends 6 of radial blades 4, with widenings 7 being directed toward intake side 8 of the turbine. Housing 1 comprises a rear wall 9 in which rotor 2 is mounted, a housing front wall 10 with intake stubs 11, and a circumferential wall 12. Housing 1, which in practice is made in several pieces, is simplified here and shown in one piece. A semicircular side channel 13 is provided to house front wall 10, said channel having its open side opposite chamber blades 5. Bottom 14 of each of chambers 15 located between two adjacent chamber blades 5 has the same radius of curvature in its radially outer area as side channel 13.

Chamber bottom 14 merges uniformly with end 3 of rotor 2 at each transition point between chamber blades 5 and radial blades 4, and chambers 15 are each open relative to flow channels 5 located between two radial blades 4, namely openings 55. As is evident from FIG. 1, side channel 13 and chambers 15 form a toroidal chamber and act as a side channel compressor, supplied by the radial compressor formed by radial blades 4. The annular diameter D of toroidal side channel 13 is greater than diameter d of the radial compressor formed by radial blades 4.

FIG. 1 also shows an interrupter 16 blocking the side channel at a transition point, said interrupter conducting the gas flow in side channel 13 in a direction antiparallel to the intake direction, into a collecting chamber 17, to whose outlet 18 a consumer is connected.

Radial blades 4 are covered on the side opposite rotor 2 by a covering wall 19 integral with the housing, said wall simultaneously forming a chamber cutoff wall 20 on the radial internal side of widening 7 of chamber blades 5. Cutoff wall 20 makes a tangential transition with the curved wall of side channel 13. End 3 of rotor 2 is sloped conically in the vicinity of radial blades 4, with the slope angle relative to rotor axis 21 being about 105°.

The radial height h by which radial blades 4 project beyond end 3 decreases uniformly radially outward. Radial blades 4 that project vertically at its inner end 22 or nearly perpendicularly to rotor 2 and the chamber blades 5 abutting them are mounted at an angle, beginning over their length relative to the end 3 of rotor 2, and curved in space, with their free upper edge leading in rotational direction U; see FIG. 2.

As is evident particularly from FIG. 2, radial blades 4 and chamber blades 5 have opposite curvatures over their lengths, with the curvature changeover point being located at their transition point 23. At transition point 23, radial blades 4 and chamber blades 5 are each inclined by the same angle b relative to circumferential tangent T at the turning point. In this embodiment, angle b is about 25°.

In the embodiment shown in FIG. 2, every second radial blade is designed as a shortened "splinter blade," which likewise makes a uniform transition to a chamber blade 5. In FIG. 2, only one radial blade 4 with its following chamber blade 5 is shown completely, while the other blades 4, 5, 24 are represented only by dot-dashed lines.

An interrupter 16 is located at one circumferential point in side channel 13, indicated schematically in FIG. 2 by the two dashed lines.

Figure 3:
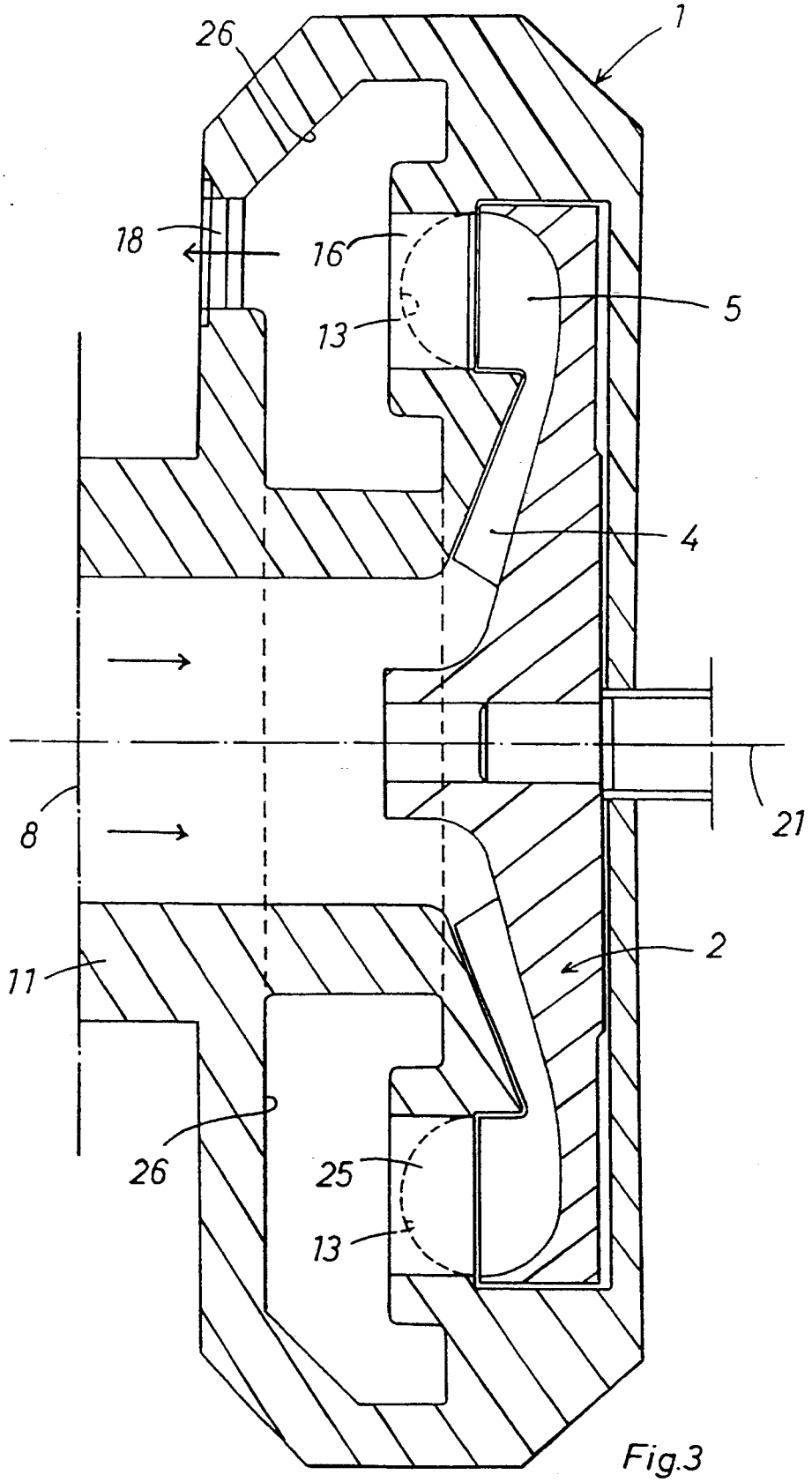
FIG. 3 is an axial section through a second embodiment of a turbine according to the invention.

In the embodiment according to FIG. 3, a rotor identical to the one in the embodiment shown in FIGS. 1 and 2 is provided, but in this case side channel 13 is interrupted at two diametrally opposite points by an interrupter 16, 25. In FIG. 2, the position of second interrupter 25 is represented by dot-dashed lines. Both interrupters 16, 25 conduct the gas flow into a common annular collecting channel 26, to which a consumer can be connected in turn through an outlet 18.

According to the invention, however, it is also possible to align interrupters 16, 25 and possibly other interrupters with a separate collecting chamber 17, each with its own outlet 18, so that various consumers can be connected simultaneously to the turbine. It is also possible under these conditions to distribute two or more interrupters unequally over the circumference of side channel 13, so that different volume flows and different pressures are available for the consumers to be connected at the individual collecting chambers 17. When several interrupters are provided, it is important to note that the tilting moments appearing at the rotor must be compensated as much as possible.

Figures 4, 5:
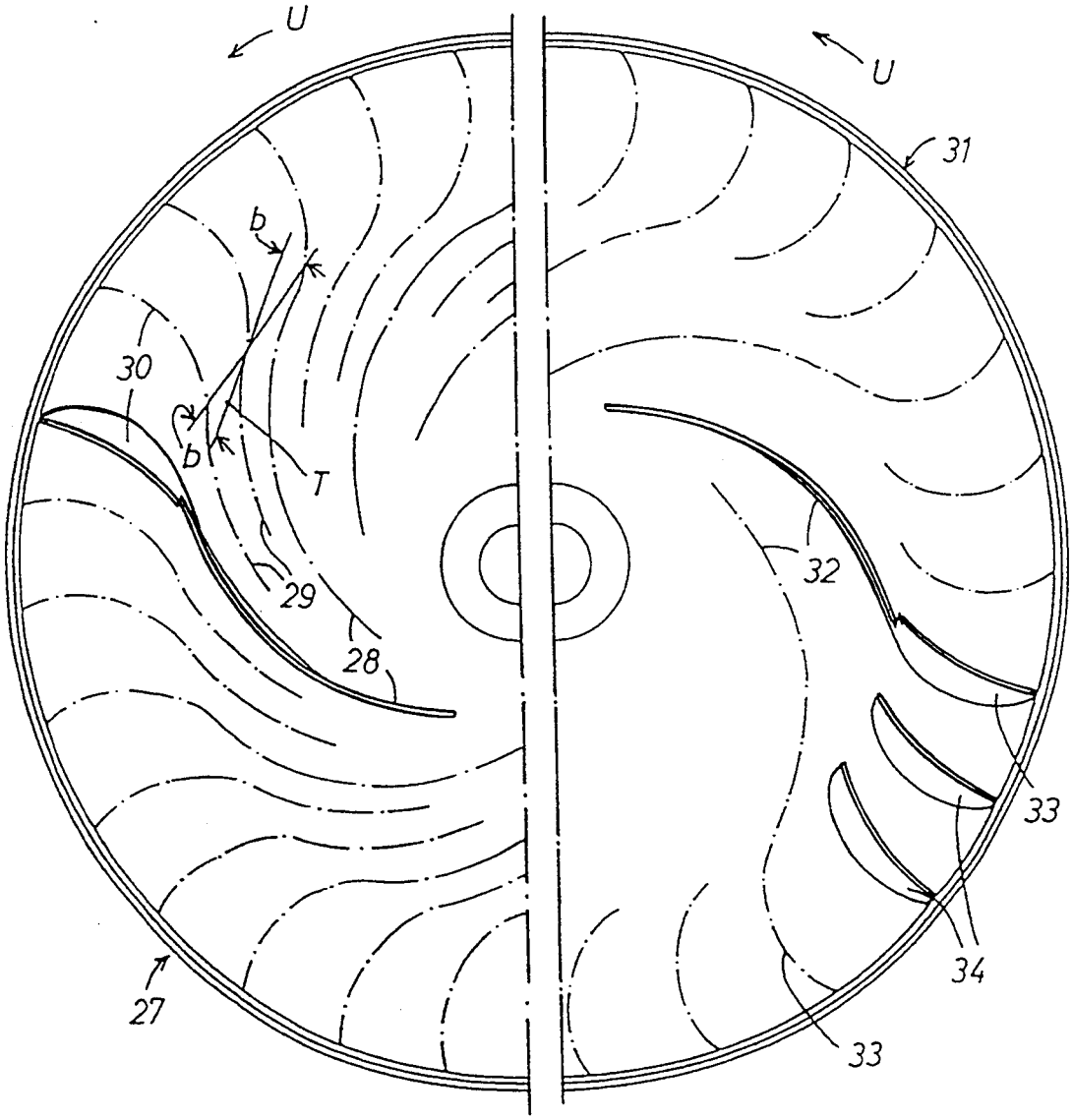
FIG. 4 is an end view of a modified embodiment of the rotor.
FIG. 5 is an end view of another revised embodiment of the rotor.

FIG. 4 shows a modified embodiment of a rotor 27 in which two splinter blades 29 are located between each two radial blades 28. The angle of inclination h of radial blades 28 and splinter blades 29 and chamber blades 30 relative to circumferential tangent B in the transition area is approximately 15° here. Chamber blades 30 are set and greater angles here in the lengthwise direction relative to the circumferential direction than in the rotor according to FIG. 2.

FIG. 5 shows a rotor 31 in which two additional chamber blades 34 are provided between each two radial blades 32 located relatively far apart, with a following chamber blade 33, with no radial blades associated with said chamber blades.

Figure 6:
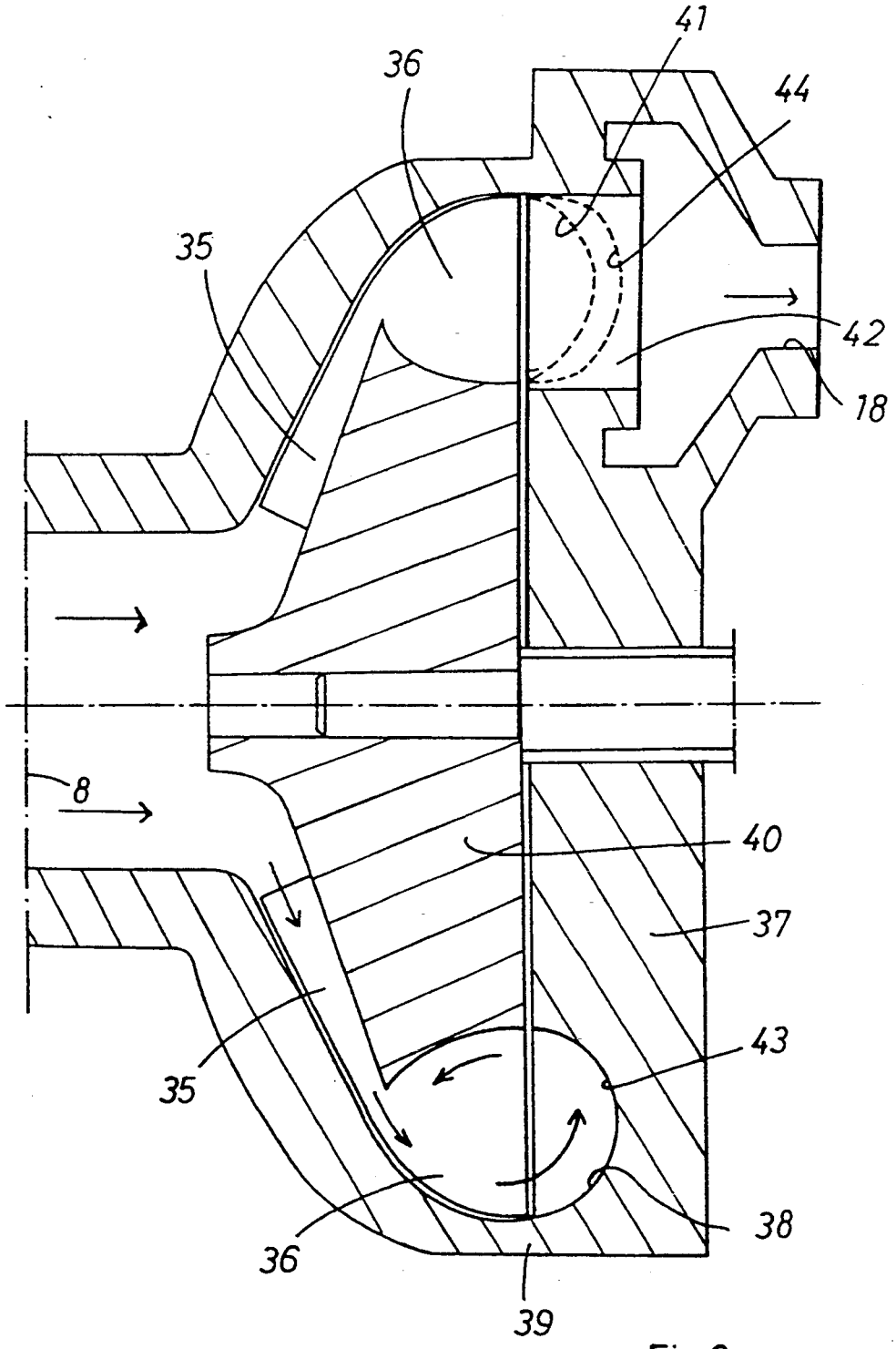
FIG. 6 is an axial section through another embodiment of a turbine according to the invention.

FIG. 6 shows an embodiment of the turbine in which chamber blades 36 abutting radial blades 35 are directed toward back wall 37 of the housing opposite intake side 8, in which wall side channel 38 is formed. Chambers located between chamber blades 36 are sealed off by housing circumferential wall 39 outwardly and by rotor body 40 inwardly. In this embodiment, the gas stream delivered by radial blades 35 is conducted in the direction of the lengthwise dimension of radial blades 35 into the chambers and side channel 38 of the side channel compressor, whereupon the gas flow undergoes a much lesser deflection than in the embodiment shown in FIG. 1, where the gas stream is bent back when it enters the side channel compressor. Side channel 38 expands uniformly over its circumference, with its smallest cross section 41 being located directly behind interrupter 42 and making a transition through a central cross section 43 to its largest cross section 44, located directly in front of interrupter 42, as indicated by the dashed lines in FIG. 6. Outlet 18 of the turbine is located at the back of the housing opposite intake side 8. This embodiment is suitable for a multistage turbine in which several systems according to FIG. 6 are connected in series.

Figure 7:
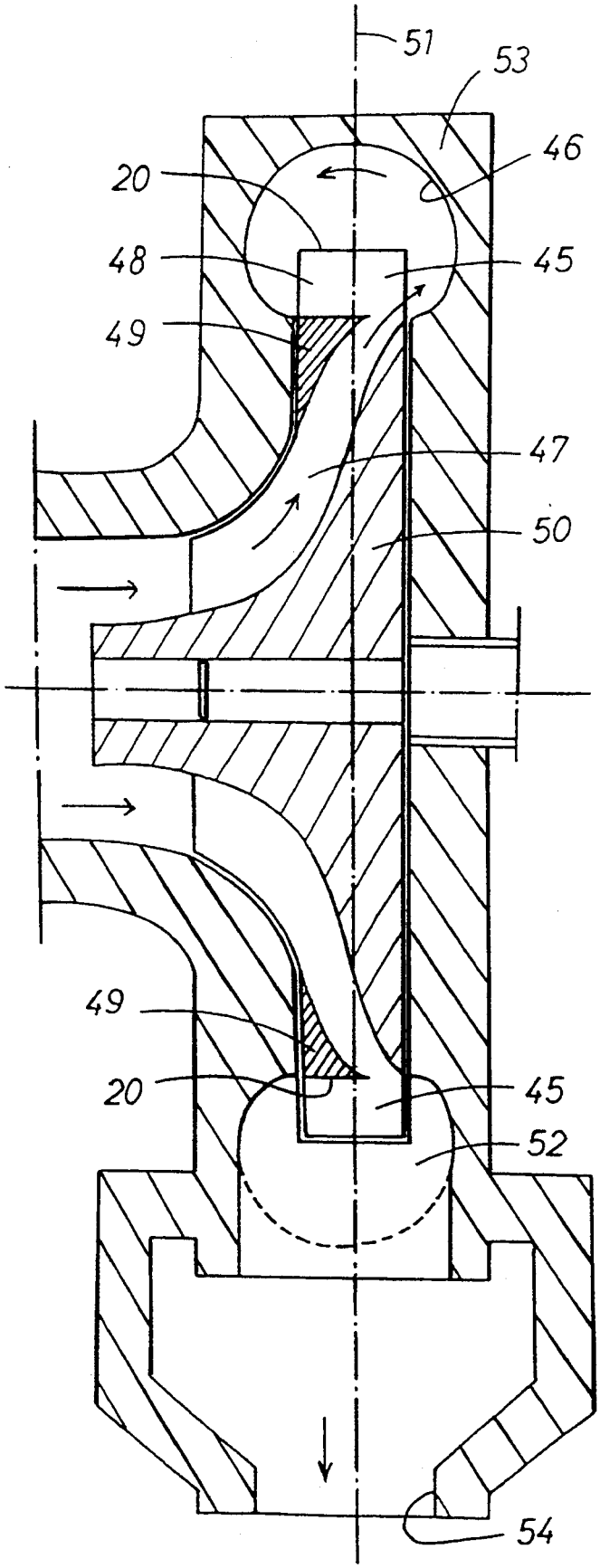
FIG. 7 is an axial section of yet another embodiment of the turbine according to the invention.

Finally, FIG. 7 shows an embodiment in which chamber blades 45 project radially into a side channel 46. Radial blades 47 and widenings 48 of chamber blades 45 are covered by a covering disk 49 of rotor 50. Chamber blades 45, shown as rectangular in the view in FIG. 7, form chambers that are open both radially outward and in both axial directions to side channel 46. Side channel 46 surrounds rotor 50 as a peripheral channel and is symmetrical to a diametral plane 51 that runs through the center of the axial extension of chamber blades 45. An interrupter 52 surrounds chamber blades 45 on their three free sides and conducts the gas flow to an outlet 54 provided on housing circumferential wall 53.

Figure 8:
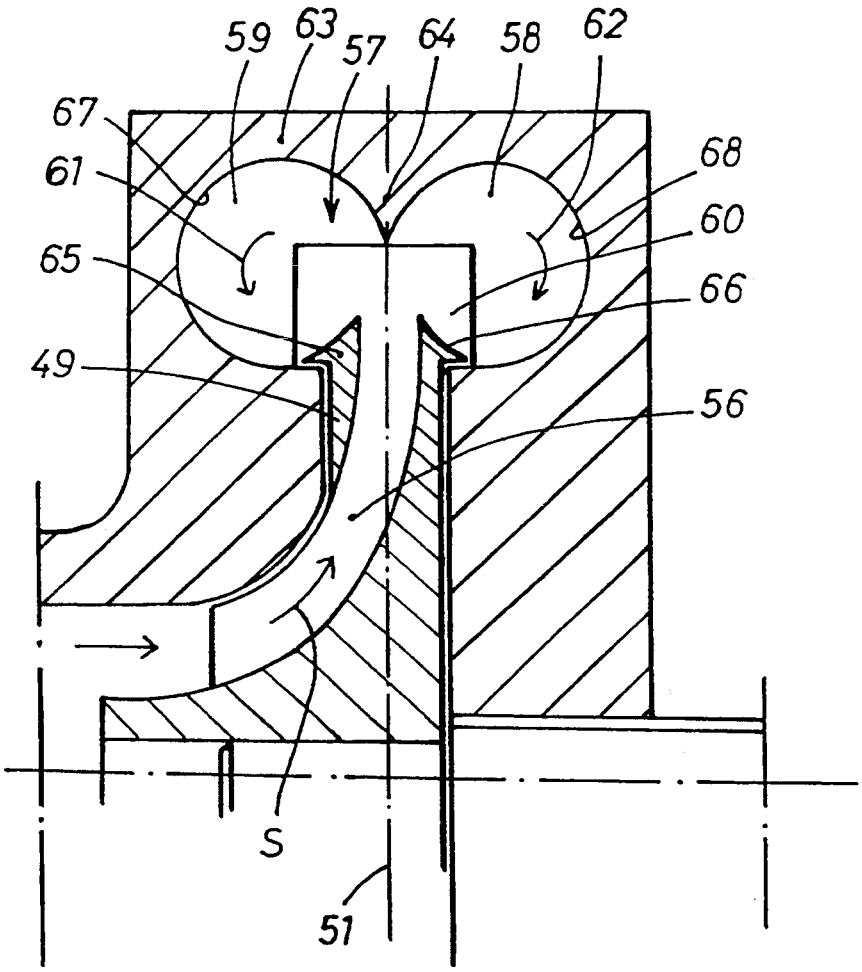
FIG. 8 is a modification of the embodiment in FIG. 7.

FIG. 8 shows a modification of the embodiment in FIG. 7. Flow channels S located between radial blades 56 here terminate radially in a peripheral double side channel 57, which has two circulation chambers 58, 59 located axially side by side, into which chamber blades 60 each project half way so that the volume flows delivered by the radial compressor break down into two circulation flow 61, 62. For mutual delimitation of these circulation flows, rounded flow shapers 64, 65, 66 are formed on housing wall 63 and on each half of chamber blades 60, said formers narrowing double-side channel 57 in the middle and lengthening walls 67, 68 of circulation chambers 58, 59, which are circular in cross section, to promote the flow.

In all of the embodiments shown, the curvature turning point is located between convexly curved radial blades 4 and concavely curved chamber blades 5, exactly at the outer circumference of the radial compressor, i.e. at openings 55 in FIG. 1. It is also possible, however, to locate the curvature change point within a given transitional area between radial blades 4 and chamber blades 5, whereupon for example an outer end segment of radial blades 4 already has a slightly concave curvature or an inner end section of chamber blades 5 has a slightly convex curvature.

We claim:

1. Turbine with a radial compressor rotor having radial blades, said radial compressor rotor feeding a side channel compressor, said side channel compressor having a ring of chambers separated by chamber blades mounted on the rotor, with an annular diameter of a side channel of the side channel compressor being equal to or larger than the diameter of a part of the rotor bearing the radial blades, with chambers having openings on their sides abutting outer ends of the radial blades, and with the radial blades making a uniform transition in a flow direction to the chamber blades, characterized by the turbine being designed as a gas compressor, by the chamber blades and the radial blades each having opposite curvatures in an end view, by the chamber blades and the radial blades having a curvature change point at their transition point, and by the chamber and the radial blades being inclined at an angle that is uniform and less than 30° relative to a circumferential tangent at the transition point.

2. Turbine according to claim 1, characterized by the radial blades projecting at their radial inner ends essentially at right angles from the rotor and following the chamber blades, increasing with their length, being inclined forward relative to the rotor plane.

3. A turbine according to claim 2, wherein the chamber blades are inclined in a direction of rotation of the rotor.

4. Turbine according claim 1, characterized by an end of the rotor bearing the radial blades being conical and by the radial blades being inclined at an angle to a rotor axis in their lengthwise dimension.

5. Turbine according to claim 1, characterized by the side channel being formed in a housing front wall which has a rotor intake side, and being located axially next to the chamber blades.

6. Turbine according to claim 4, characterized by the side channel being formed in a housing back wall opposite a rotor intake side and being located axially next to the chamber blades.

7. Turbine according to claim 1, characterized by a side channel formed in a circumferential wall of a housing of the turbine, and by the chamber blades projecting radially outward into the side channel.

8. Turbine according to claim 1, characterized by a plurality of interrupters distributed over a circumference of the side channel in an arrangement that compensates for their tilting moments.

9. Turbine according to claim 8, wherein several interrupters, are provided each interrupter is provided with a separate outlet.

10. Turbine according to claim 8, characterized by side channel expanding continuously between the back of an interrupter and the front of the next interrupter.

11. Turbine according to claim 8, wherein several interrupters are provided, and wherein all interrupters are connected by an annular collecting channel to a common outlet.

12. Turbine according to claim 1, characterized by part of the radial blades being made in the form of shortened splinter blades.

13. Turbine according to claim 1, characterized by additional separate chamber blades being provided on rotor between chamber blades that are integral with radial blades.

14. Turbine according to claim 1, characterized by a curvature change point being located in a vicinity of the transition between the radial blades and the chamber blades.

15. Turbine according to claim 1, characterized by the radial blades being curved convexly and the chamber blades being curved concavely.

16. A turbine according to claim 1, wherein the angle is 15° relative to the circumferential tangent at the transition point.

17. Turbine with a radial compressor rotor having radial blades, said radial compressor rotor feeding a side channel compressor, said compressor having a ring of chambers separated by chamber blades mounted on the rotor, with an annular diameter of a side channel of the side channel compressor being equal to or larger than the diameter of a part of the rotor bearing the radial blades, with chambers having openings on their sides abutting outer ends of the radial blades, and with the radial blades making a uniform transition in a flow direction to the chamber blades, characterized by the turbine being designed as a gas compressor, by the chamber blades and the radial blades each having opposite curvatures in an end view, by the chamber blades and the radial blades having a curvature change point at their transition point, and by the chamber and the radial blades being inclined at an angle that is uniform and less than 30° relative to a circumferential tangent at the transition point, the chamber blades each having a widening directed toward the side channel, and by the chambers being partially enclosed at a radially inward end in a vicinity of these widenings by a sealing wall.

18. Turbine with a radial compressor rotor having radial blades, said radial compressor rotor feeding a side channel compressor, said compressor having a ring of chambers separated by chamber blades mounted on the rotor, with an annular diameter of a side channel of the side channel compressor being equal to or larger than the diameter of a part of the rotor bearing the radial blades, with chambers having openings on their sides abutting outer ends of the radial blades, and with the radial blades making a uniform transition in a flow direction to the chamber blades, characterized by the turbine being designed as a gas compressor, by the turbine blades and the radial blades each having opposite curvatures in an end view, and by the chamber blades and the radial blades having a curvature change point at their transition point, and by the chamber and the radial blades being inclined at an angle that is uniform and less than 30° relative to a circumferential tangent at the transition point, a height of the radial blades decreasing radially outward, and a covering wall on the housing side or covering disk molded on the rotor being associated with the radial blades on their sides opposite the rotor, and a covering wall or covering disk simultaneously forming a sealing wall of the chambers in a vicinity of widenings of the respective chamber blades.

19. Turbine with a radial compressor rotor having radial blades, said radial compressor rotor feeding a side channel compressor, said compressor having a ring of chambers separated by chamber blades mounted on the rotor, with an annular diameter of a side channel of the side channel compressor being equal to or larger than the diameter of a part of the rotor bearing the radial blades, with chambers having openings on their sides abutting outer ends of the radial blades, and with the radial blades making a uniform transition in a flow direction of the chamber blades, characterized by the turbine being designed as a gas compressor, by the chamber blades and the radial blades each having opposite curvatures in an end view, and by the chamber blades and the radial blades having a curvature change point at their transition point, and by the chamber and the radial blades being inclined at an angle that is uniform and less than 30° relative to a circumferential tangent at the transition point, the side channel is formed in a circumferential wall of the housing of the turbine, the chamber blades project radially outward into the side channel, and, flow channels are located between two radial blades terminating radially in a peripheral double-side channel, said channel having two adjacent circulation chambers into which each of chamber blades projects halfway.

20. Turbine according to claim 19, characterized by rounded flow shapers being molded on a housing wall and on the chamber blades, said shapers constricting the peripheral double-side channel in the middle and largely separating the two circulating chambers from one another.

* * * * *